US007857640B1

(12) United States Patent
Lee et al.

(10) Patent No.: US 7,857,640 B1
(45) Date of Patent: Dec. 28, 2010

(54) ELECTRIC CONNECTOR EQUIPPED WITH MULTIPLE LAYERS OF SAFETY STRUCTURE

(75) Inventors: Chiu-San Lee, Taipei (TW); Yi-Hsun Lee, Taipei (TW); Su-Chen Shen, Taipei (TW)

(73) Assignee: XYZ Science Co., Ltd., Taipei County (TW)

( * ) Notice: Subject to any disclaimer, the term of this patent is extended or adjusted under 35 U.S.C. 154(b) by 0 days.

(21) Appl. No.: 12/642,112

(22) Filed: Dec. 18, 2009

(51) Int. Cl.
*H01R 13/44* (2006.01)

(52) U.S. Cl. ..... 439/137; 439/490

(58) Field of Classification Search ..... 439/135, 439/137, 140, 141, 146
See application file for complete search history.

(56) References Cited

U.S. PATENT DOCUMENTS 5,702,259 A * 12/1997 Lee ..... 439/137
7,527,508 B1 * 5/2009 Lee et al. ..... 439/137
7,753,700 B2 * 7/2010 Ma ..... 439/133

FOREIGN PATENT DOCUMENTS

CN 201238098 5/2009
TW 200919869 5/2009

* cited by examiner

*Primary Examiner*—James Harvey
(74) *Attorney, Agent, or Firm*—Leong C. Lei

(57) ABSTRACT

An electric connector equipped with multiple layers of safety structure includes an insulation case, an electric connection terminal set and a safety mechanism. The insulation case has a front panel with a plurality of slots. The safety mechanism has a safety gate set and a blocking plate latching element. The safety gate set is pushed by a plug and to open the slots to allow the plug to pass through and to establish electric connection with the electric connection terminal set. The blocking plate has a brake portion. The blocking plate latching element has a stirring portion exposed outside the surface of the insulation case and a stop portion corresponding to each blocking plate. The stop portion is movable with the stirring portion to the brake portion to stop the blocking plate from moving. Thereby the blocking plate latching element can control opening of the safety gate set.

12 Claims, 12 Drawing Sheets

ELECTRIC CONNECTOR EQUIPPED WITH MULTIPLE LAYERS OF SAFETY STRUCTURE

FIELD OF THE INVENTION

The present invention relates to an electric connector equipped with multiple layers of safety structure that receives insertion of a plug to obtain and deliver electric power and provides multiple layers of protection structure to prevent inadvertent electric shock.

BACKGROUND OF THE INVENTION

The society these days has a high degree of electrification. Most indoor environments have sockets to enable electric appliances to get electric power. Universal sockets compatible to specifications of varying receptacles and plugs of different countries also are available on the market that make electric interconnection possible among different specifications of plugs and sockets. The ordinary socket and portable universal socket have to conform to the safety regulations of the country they intend marketing. And improvement of safety features is a continuous effort pursued by producers to prevent users from hazards.

A conventional universal socket, such as R.O.C. publication No. 200919869 entitled "Universal socket" provides a ground socket compatible to varying specifications of many countries. It also has a neutral slot on the left side and a line slot on the right side at the front side of the socket. The slots are open type and can receive and accumulate dust and hairs and result in short circuit or even cause electric shock to users. As the universal socket has different slots to meet the specifications of varying countries, it has a greater chance of receiving external objects. To address this issue, there are techniques proposed to add a movable safety gate in the universal slot. Applicant has applied such a technique in China patent pub. No. 201238098 entitled "Sliding safety structure for power supply sockets". In that case a power supply socket has a control seat, a safety gate and an elastic element with two ends pushing the control seat and safety gate. The control seat has a guiding rod to direct the safety gate. The elastic element butts two force receiving portions of the safety gate to close the path of a plug inserting to the socket electrode in regular conditions. When the plug electrodes are inserted into the socket, the two force receiving portions are pressed by the plug electrodes and the safety gate is pushed and slides. In the regular conditions it is at a closed position, the plug electrodes can be inserted into the socket electrodes. The aforesaid structure can enhance the safety of the socket. It also has a retaining portion to keep the safety gate at the closed position when the force receiving portions receives uneven forces. Therefore, it overcomes the flaw of the conventional safety structure that can be opened by a force from one side. Hence that application provides an adequate protection mechanism.

Although the aforesaid movable safety gate can protect the slots, the safety gate is movable and the closed condition can be achieved by pushing of the elastic element. Hence it still can be opened by purposely inserting a sharp tool (such as children inserting the slots with an article). As a result, the protection efficacy of the safety gate still has room for improvement.

SUMMARY OF THE INVENTION

In view of the conventional movable safety gate still can be opened in not regular use conditions, the primary object of the present invention is to provide an electric connector with an enhanced safety protection mechanism to prevent inadvertent opening of the safety gate.

The present invention provides an electric connector equipped with multiple layers of safety structure. The electric connector includes an insulation case, an electric connection terminal set and the safety mechanism. The insulation case has a front panel containing a plurality of slots. The slots can receive insertion of a plug and form a path of electric connection to the electric connection terminal set. The safety mechanism includes a safety gate set and a blocking plate latching element. The safety gate set has at least one bracing wall fastened to the insulation case, at least one elastic element located on the bracing wall and at least one blocking plate butted by the elastic element and interposed between the slots and the electric connection terminal set in regular conditions. The blocking plate can be pushed by the plug to compress the elastic element to produce deformation, and open the slots to receive insertion of the plug to establish electric connection with the electric connection terminal set. The blocking plate has a brake portion. The blocking plate latching element has a stirring portion exposed outside the surface of the insulation case and a stop portion corresponding to the blocking plate. The stop portion is movable with the stirring portion to the brake portion to stop movement of the blocking plate. Thereby the blocking plate latching element can control opening and closing of the safety gate set.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
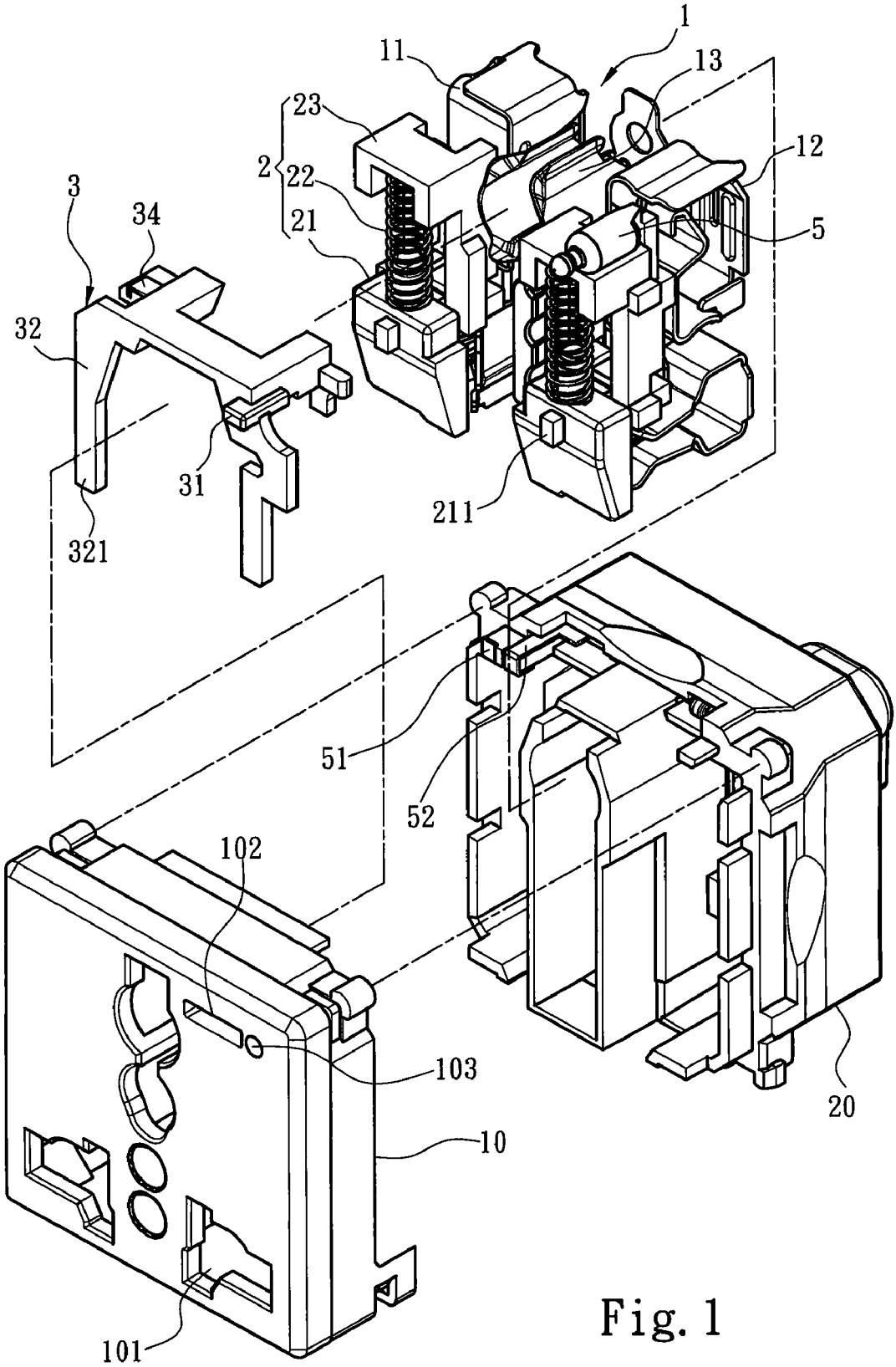
FIG. 1 is an exploded view of a first embodiment of the present invention.

Please refer to FIG. 1, the electric connector equipped with multiple layers of safety structure according to the present invention includes an insulation case which has a front panel 10 and a seat 20, an electric connection terminal set 1 and a safety mechanism held between the front panel 10 and the seat 20. The electric connection terminal set 1 includes a line terminal 11, a neutral terminal 12 (a general type is shown in the drawing, however in China, European region and other locations where the positions of the line terminal 11 and neutral terminal 12 with 220V voltage specification are switched compared with that shown in FIG. 1) and a ground terminal 13 which can be positioned selectively. The front panel 10 has a plurality of slots 101, an opening 102 and an indication window 103 which can be located as desired. The slots 101 can receive a plug (not shown in the drawings) to form a path of electric connection with the electric connection terminal set 1. The safety mechanism includes a safety gate set 2 and a blocking plate latching element 3. The safety gate set 2 has at least one bracing wall 23 fastened to the insulation case, at least one elastic element 22 located on the bracing wall 23, and at least one blocking plate 21 butted by the elastic element 22 and interposed between the slots 101 and the electric connection terminal set 1 in regular conditions. In an embodiment shown in FIG. 1, the ground terminal 13 is located between the line terminal 11 and neutral terminal 12, hence two blocking plates 21 are provided respectively to block the slots 101 leading to the line terminal 11 and neutral terminal 12. The blocking plate 21 is retracted upwards when the plug (not shown in the drawings) is inserted to compress the elastic element 22 which stores elastic force. The blocking plate 21 has a brake portion 211. The blocking plate latching element 3 has a stirring portion 31 exposed outside the surface of the insulation case and an extended leg 32 corresponding to each blocking plate 21. The extended leg 32 has a stop portion 321 which is movable with the stirring portion 31 to a closed position to latch the brake portion 211 to stop the blocking plate 21 from moving. In the embodiment shown in FIG. 1, the brake portion 211 can be a boss to latch the stop portion 321 to prevent the blocking plate 21 from moving, thereby the blocking plate latching element 3 can control opening and closing of the safety gate set 2.

Figure 2A:
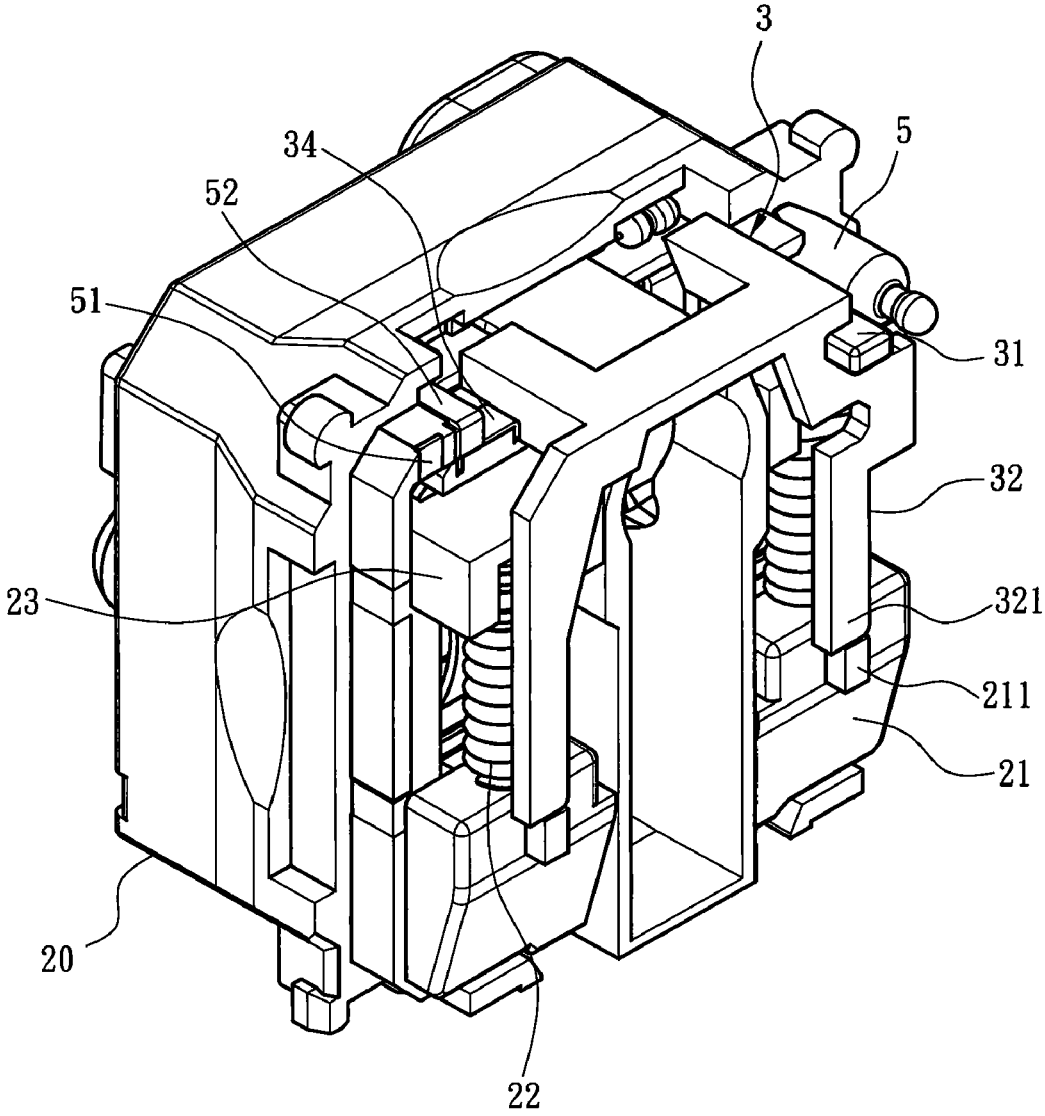
FIG. 2A is a schematic view of the first embodiment in operating condition-1.
Figure 2B:
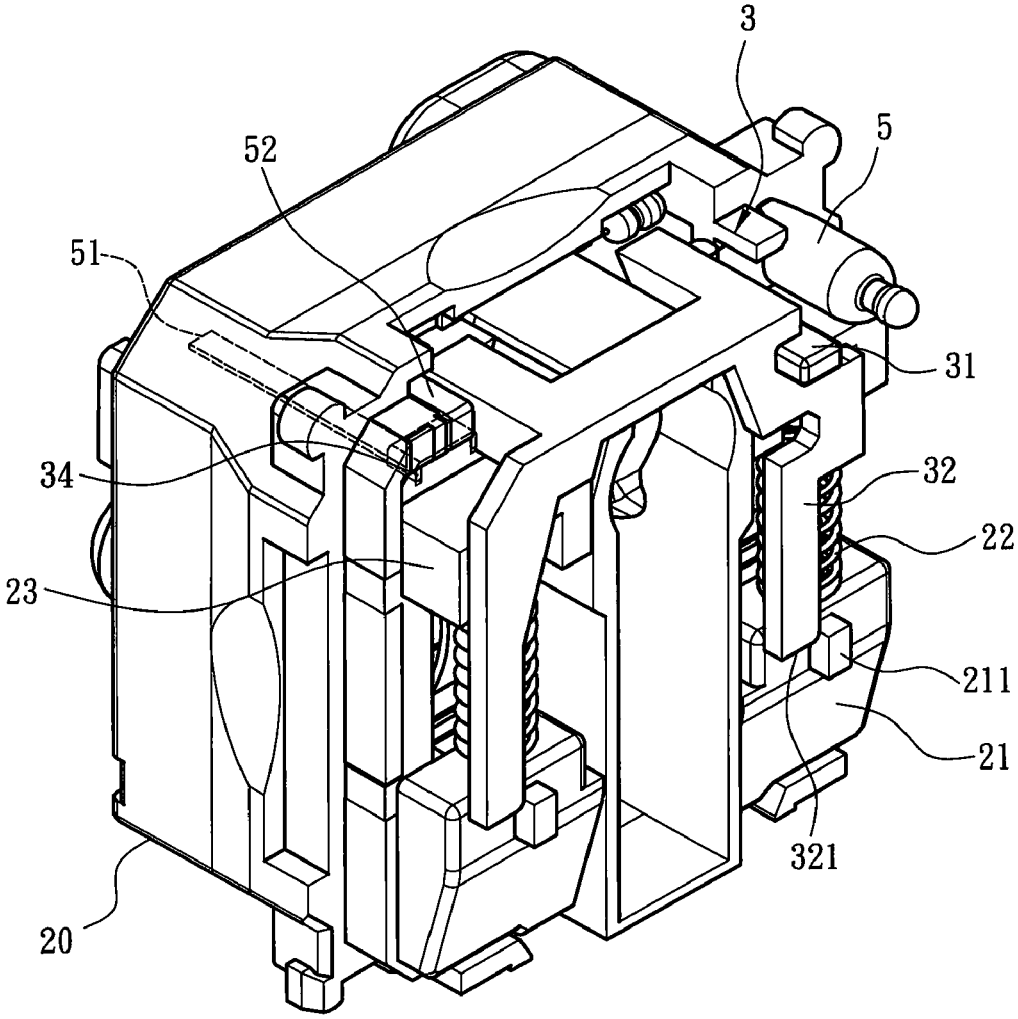
FIG. 2B is a schematic view of the first embodiment in operating condition-2.

Referring to FIG. 2A, when the blocking plate latching element 3 is at a closed position (with the stirring portion 31 runs through the opening 102 at an "OFF" end of the opening 102 of the front panel 10), the stop portion 321 is exactly located on the brake portion 211 to stop the blocking plate 21 to move. While the blocking plate latching element 3 is located at the closed position, the safety gate set 2 cannot be pushed to form electric connection with the electric connection terminal set 1 no matter insertion of the plug or any external article. Referring to FIG. 2B, the stirring portion 31 can be moved by a user to push the blocking plate latching element 3 to an open position (with the stirring portion 31 moved to a corresponding "ON" end of the opening 102 of the front panel 10); the stop portion 321 is moved away so that there is no obstacle on the moving path of the brake portion 211 on the blocking plate 21, and the plug can push the blocking plate 21 away to form electric connection with the electric connection terminal set 1. By means of the structure set forth above, the user can choose to close the slots 101 through the blocking plate latching element 3 when the electric connector is not in use to prevent external articles from entering and also prevent children from suffering inadvertent electric shock.

Referring to FIG. 1, the insulation case may selectively install a lighting circuit to obtain electric power from the electric connection terminal set 1. The lighting circuit has a first terminal 51 and a second terminal 52 that are separated to form an open circuit and an indication lamp 5 is connected to the lighting circuit. The blocking plate latching element 3 has a conduction bridge plate 34 to establish electric connection between the first terminal 51 and second terminal 52 with the movement of the blocking plate latching element 3 so that the lighting circuit is set ON to light the indication lamp 5. As shown in FIG. 2A, when the blocking plate latching element 3 is located at the closed position, the conduction bridge plate 34 wedged on the blocking plate latching element 3 is connected only to the second terminal 52 and forms an open circuit with the first terminal 51, hence the indication lamp 5 is set off without lighting. Referring to FIG. 2B, when the blocking plate latching element 3 is at an open condition, the conduction bridge plate 34 is moved between the first and second terminals 51 and 52 to establish electric connection between them, and the indication lamp 5 is set on to light. Through the indication window 103 on the front panel 10, the light of the indication lamp 5 can project outside the front panel 10. Therefore, users can check whether the slot 101 of the electric connector is in the closed state through visual sight.

Figure 3:
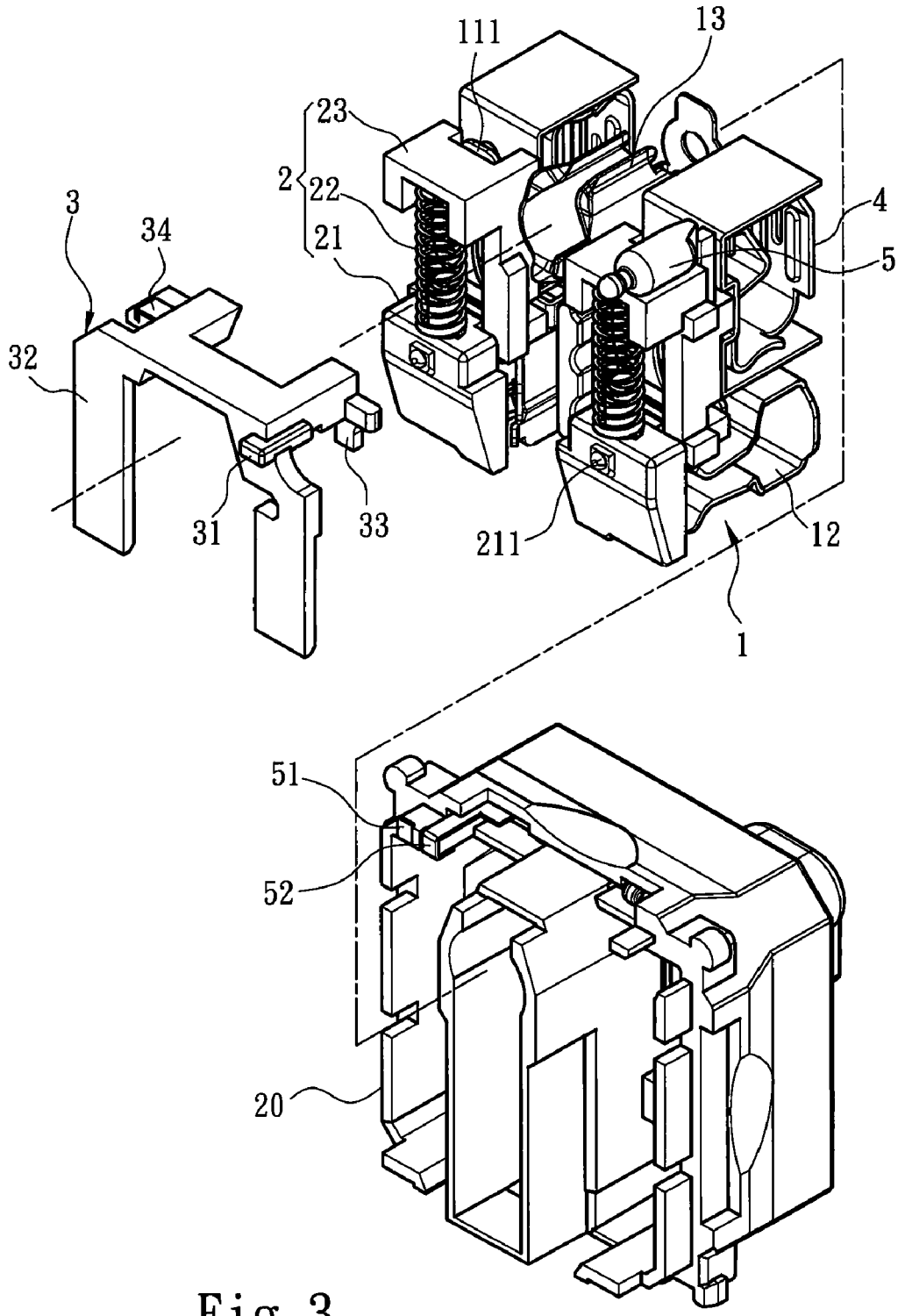
FIG. 3 is an exploded view of a second embodiment of the present invention.
Figure 4:
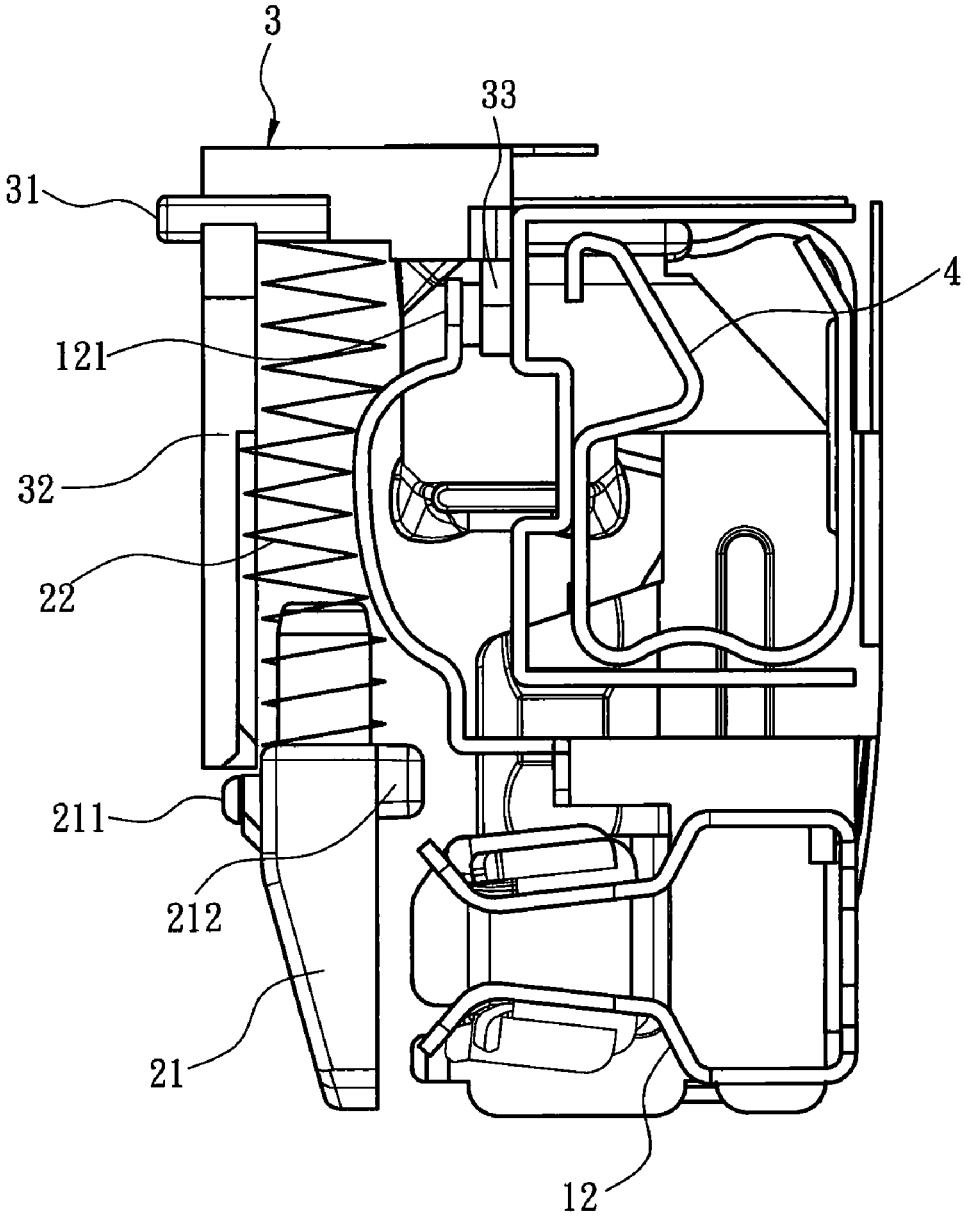
FIG. 4 is a side view of the second embodiment of the present invention.
Figure 5A:
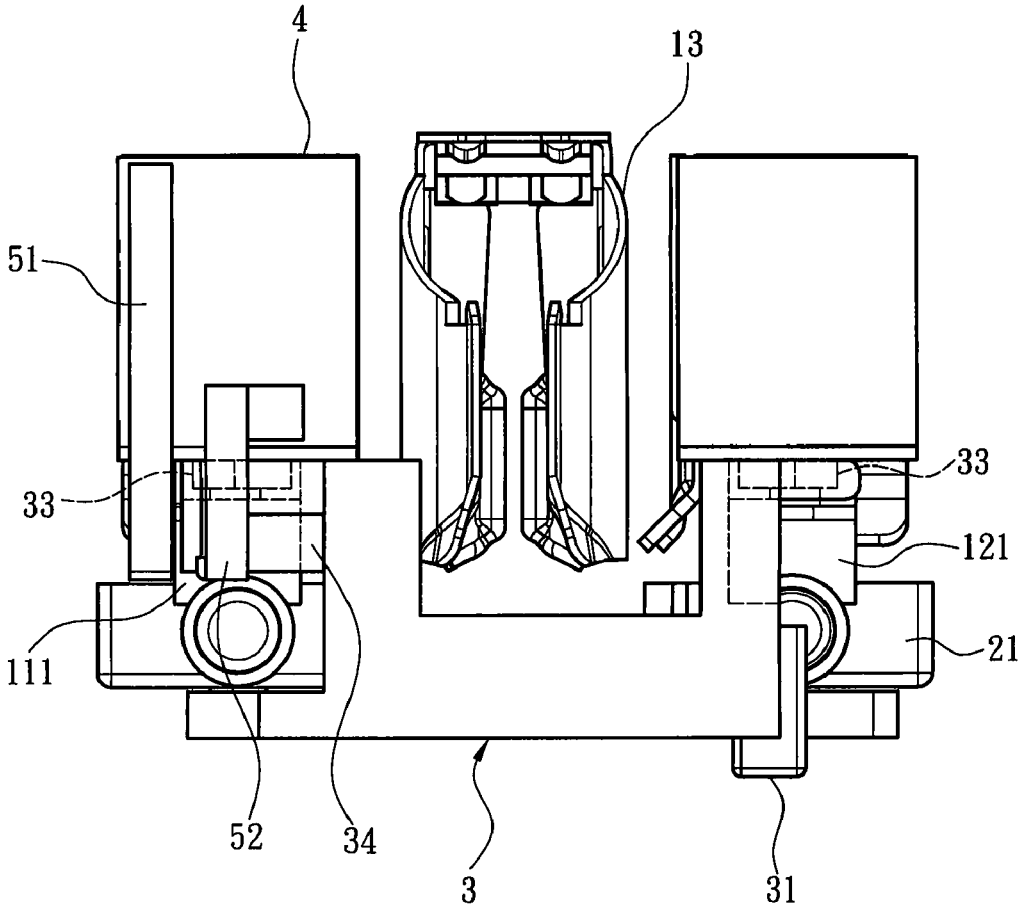
FIG. 5A is a schematic view of the insulation plate in operating condition-1.
Figure 5B:
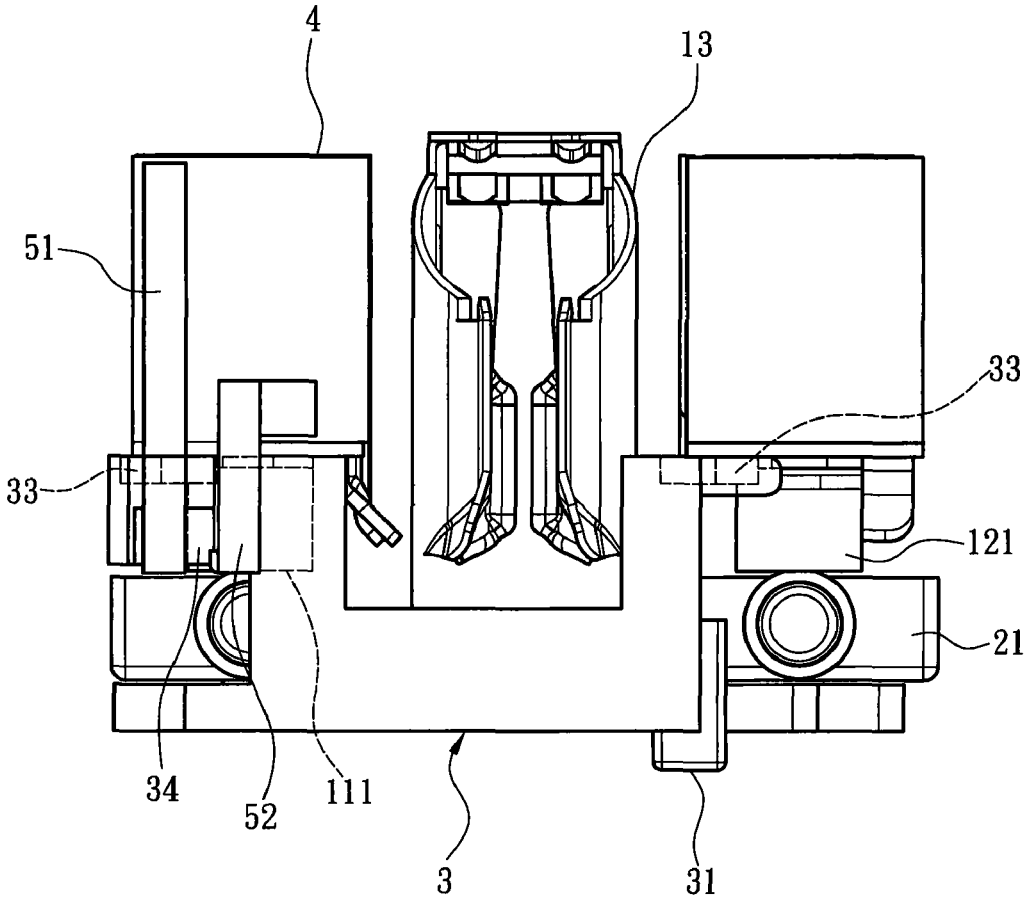
FIG. 5B is a schematic view of the insulation plate in operating condition-2.
Figure 6A:
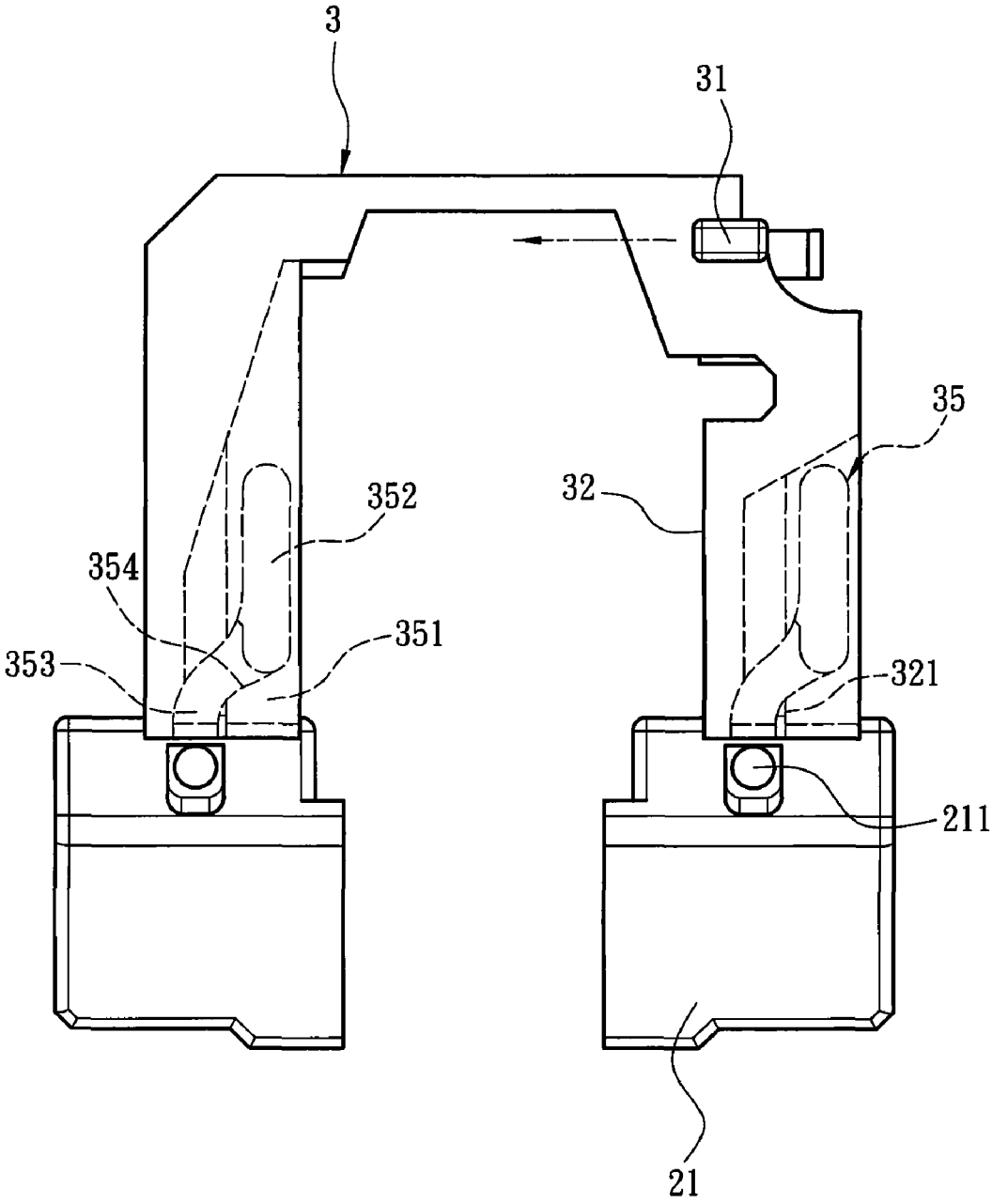
FIG. 6A is a schematic view of the blocking plate and return structure in operating condition-1.
Figure 6B:
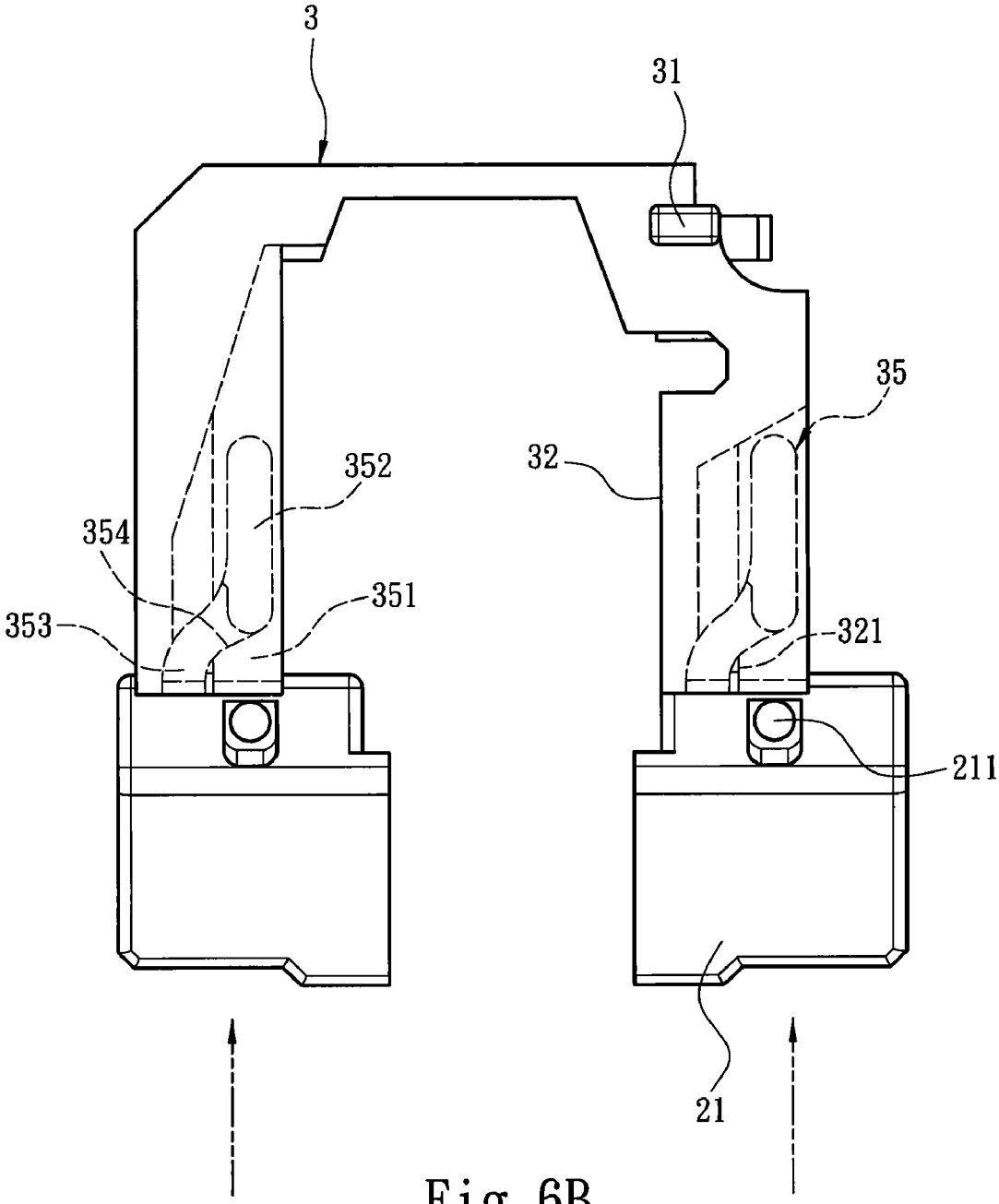
FIG. 6B is a schematic view of the blocking plate and return structure in operating condition-2.
Figure 6C:
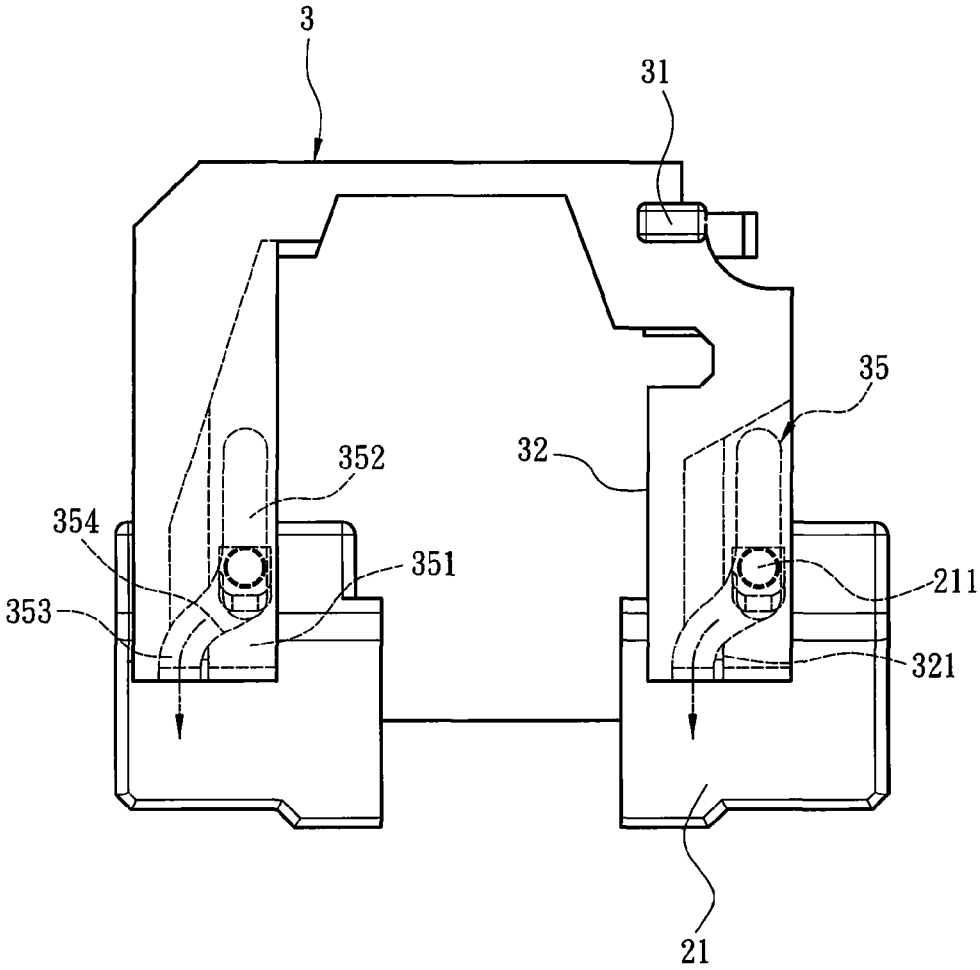
FIG. 6C is a schematic view of the blocking plate and return structure in operating condition-3.
Figure 6D:
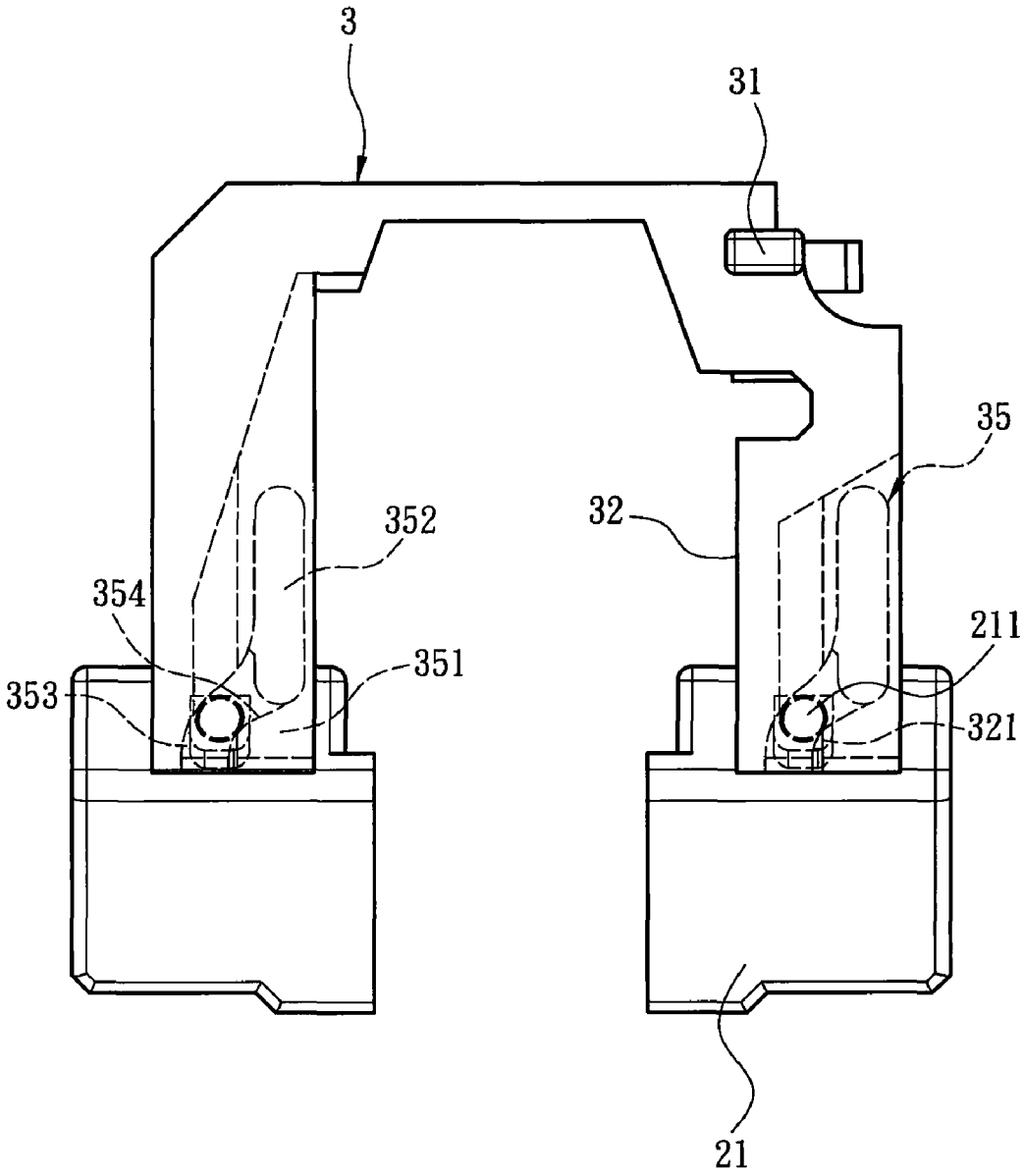
FIG. 6D is a schematic view of the blocking plate and return structure in operating condition-4.

By means of the construction set forth above, the electric connector provides a first layer protection through the safety gate set 2, and a second layer protection through the blocking plate latching element 3. Refer to FIGS. 3 and 4 for another embodiment of the present invention. To further enhance the protection mechanism, the insulation case is divided into multiple compartments to allow the plug to occupy some of the compartments in the electric connection terminal set 1 after insertion. A separated compartment in the electric connection terminal set 1 is allocated to hold a conduction terminal set 4 which has to be connected to the electric connection terminal set 1 to establish electric connection in the electric connector. The line terminal 11 and neutral terminal 12 of the electric connection terminal set 1 are extended respectively to form a connection arm 111 and 121 which are spaced from the conduction terminal set 4 with the separated compartment. As shown in FIG. 4, the neutral terminal 12 and the conduction terminal set 4 are separated, and the connection arm 121 extended from the neutral terminal 12 is spaced from the conduction terminal set 4 in regular conditions. The blocking plate 21 has a pushing portion 212 on one side facing the electric connection terminal set 1 and the conduction terminal set 4. When the blocking plate 21 is pushed upwards by the plug, the pushing portion 212 presses the connection arm 121 to connect the conduction terminal set 4 so that the electric connection terminal set 1 and the conduction terminal set 4 in the electric connector are connected to form electric connection. Hence separation of the conduction terminal set 4 and the electric connection terminal set 1 can be regarded as a third layer protection mechanism to make the electric connection terminal set 1 unable to establish electric connection in non-regular conditions. The blocking plate latching element 3 may further isolate the electric connection terminal set 1 and conduction terminal set 4. As shown in the drawings, the blocking plate latching element 3 may extend at least one isolation plate 33 movable with the stirring portion 31, and the isolation plate 33 moves to the isolated compartment between the conduction terminal set 4 and connection arms 111 and 121 to separate the connection arms 111 and 121 to connect with the conduction terminal set 4. Referring to FIG. 5A, when the blocking plate latching element 3 is located at the closed position, the isolation plate 33 is interposed between the connection arms 111 and 121 and the conduction terminal set 4 so that the connection arms 111 and 121 cannot be connected with the conduction terminal set 4 to form electric connection. Referring to FIG. 5B, when the blocking plate latching element 3 is moved, the isolation plate 33 also is moved away, the connection arms 111 and 121 are pushed by the pushing portion 212 to connect to the conduction terminal set 4 to establish electric connection.

Furthermore, to enable the blocking plate latching element 3 to equip with an automatic closed capability, a return structure 35 can be formed on the blocking plate latching element 3. The return structure 35 can release the stored elastic force from movement of the blocking plate latching element 3 or the blocking plate 21 to return the position of the blocking plate latching element 3 before moving. The return structure 35 can be implemented through an elastic element butting the blocking plate latching element 3. When the blocking plate latching element 3 is moved, the elastic force is stored to push the blocking plate latching element 3 to return to its original position before moving. FIGS. 6A through 6D illustrate an embodiment that are adopted. The return structure 35 located on the extended leg 32 includes a first track 351 to allow the brake portion 211 to slide in, a common track 352 and a second track 353 to allow the brake portion 211 to slide out. The second track 353 has an opening where a spacer type stop portion 321 is located. The brake portion 211 is a boss type block with an arched flange formed thereon to mate the return structure 35. When the blocking plate latching element 3 is located at the closed position, the blocking plate 21 is blocked by the stop portion 321 without moving (referring to FIG. 6A). When the blocking plate latching element 3 is moved, the brake portion 211 can slide in through the first track 351 which has an elevation difference with the common track 352 at the junction thereof so that the brake portion 211 can slide only one way from the first track 351 to the common track 352 (referring to FIGS. 6B and 6C). When the plug is moved away from the electric connector, the blocking plate 21 is pushed by the elastic element 22 (referring to FIG. 3) to return to its original position. As the common track 352 and the second track 353 are interposed by a force receiving arched surface 354 (referring to FIG. 6D), through an inclined section formed between a lower edge of the brake portion 211 and an upper edge of the stop portion 321, the brake portion 211 can slide over the stop portion 321 to its original position. When the brake portion 211 returns to its original position, the force receiving arched surface 354 is pushed to move the blocking plate latching element 3 to return to the closed position so that the electric connector is closed automatically. The stirring portion 31 has to be stirred to move the blocking plate latching element 3 to the opening position to receive insertion of the plug, hence external articles cannot enter the electric connector except the plug. The return structure 35 is directly formed on the extended leg 32 without occupying extra space.

Figure 7:
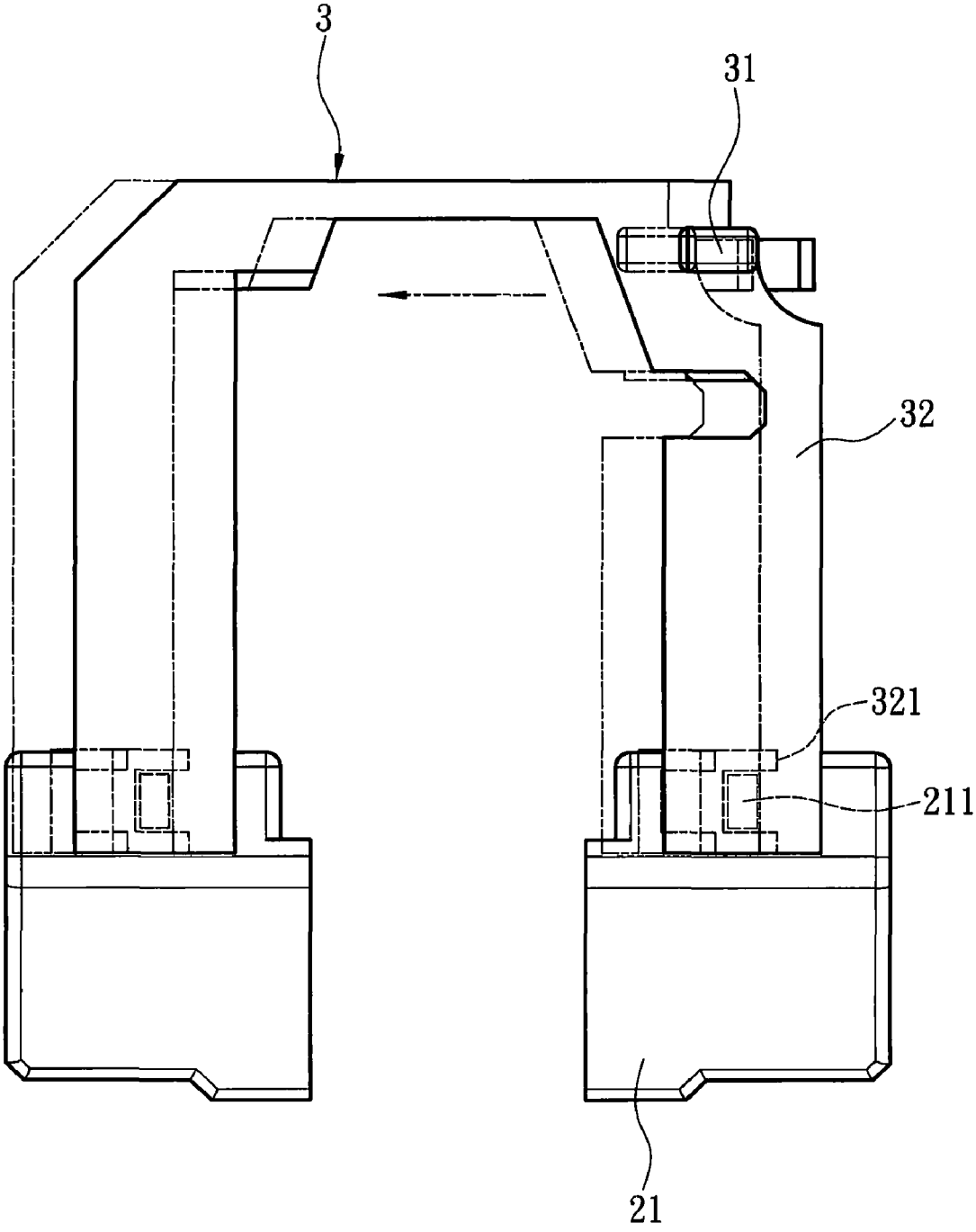
FIG. 7 is a schematic view of another embodiment of the stop portion.

The structure of the present invention previously discussed provides multiple layers of protection mechanism for the electric connector to prevent users or children from inadvertent electric shock. While the preferred embodiments of the invention have been set forth for the purpose of disclosure, they are not the limitations of the invention. For instance, in the event that the electric connector has only the line terminal 11 and neutral terminal 12, the safety gate set 2 can use one blocking plate 2 to block the slot 101 leading to the line terminal 11 and neutral terminal 12. Moreover, as long as the stop portion 321 can limit the movement of the brake portion 211, there is no restriction on the form of the stop portion 321. The stop portion 321 shown in FIG. 7 is a trough type latch structure to confine the movement of the brake portion 211. Thus modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An electric connector equipped with multiple layers of safety structure, comprising an insulation case, an electric connection terminal set and a safety mechanism, the insulation case including a front panel with a plurality of slots formed thereon to receive insertion of a plug to establish a electric connection path with the electric connection terminal set, the safety mechanism comprising:

a safety gate set which comprises at least one bracing wall fastened to the insulation case, at least one elastic element located on the bracing wall and at least one blocking plate butted by the elastic element and interposed between the slots and the electric connection terminal set in regular conditions, the blocking plate being pushed by the plug to compress the elastic element to deform and open the slots, the blocking plate further including a brake portion; and a blocking plate latching element which comprises a stirring portion exposed outside the surface of the insulation case and an extended leg corresponding to each blocking plate, the extended leg including a stop portion movable with the stirring portion to a closed position to latch the brake portion to stop the blocking plate from moving thereby to allow the blocking plate latching element to control opening of the safety gate set.

2. The electric connector of claim 1, wherein the electric connection terminal set comprises a line terminal and a neutral terminal, the safety gate set blocking the slots leading to the line terminal and the neutral terminal through one blocking plate.

3. The electric connector of claim 1, wherein the electric connection terminal set comprises a line terminal and a neutral terminal, the safety gate set blocking the slots leading to the line terminal and the neutral terminal through two blocking plates.

4. The electric connector of claim 3, wherein the electric connection terminal set further comprises a ground terminal.

5. The electric connector of claim 1, wherein the brake portion of the blocking plate is a boss to latch the stop portion and to stop the blocking plate from moving.

6. The electric connector of claim 1, wherein the insulation case holds a conduction terminal set in a compartment insulated from the electric connection terminal set, the line terminal and the neutral terminal of the electric connection terminal set that are extended to form respectively a connection arm which is spaced from the conduction terminal set with insolated compartments, the blocking plate including a pushing portion to push the connection arms to connect to the conduction terminal set to establish electric connection when the blocking plate is moved.

7. The electric connector of claim 6, wherein the blocking plate latching element further comprises at least one isolation plate movable with the stirring portion, the stirring portion driving the isolation plate to move to an isolated compartment between the conduction terminal set and the connection arms to isolate the connection arms from connecting to the conduction terminal set.

8. The electric connector of claim 1, wherein the insulation case further comprises a lighting circuit to receive electric power from the electric connection terminal set and an indication lamp connecting to the lighting circuit, the lighting circuit including a first terminal and a second terminal that are separable to form an open circuit, the blocking plate latching element including a conduction bridge plate movable with the blocking plate latching element to establish electric connection with the first terminal and the second terminal so that the lighting circuit is set on to light the indication lamp.

9. The electric connector of claim 8, wherein the front panel includes an indication window to allow the light of the indication lamp to be projected outside the front panel.

10. The electric connector of claim 1, wherein the blocking plate latching element includes a return structure to release an elastic force stored by moving the blocking plate latching element or the blocking plate to return the blocking plate latching element to an original position before moving.

11. The electric connector of claim 10, wherein the return structure includes an elastic element butting the blocking plate latching element to store the elastic force during the blocking plate latching element moving to push the blocking plate latching element to return to the original position before moving.

12. The electric connector of claim 10, wherein the return structure comprises a first track located on the extended leg to allow the brake portion to slide in, a common track and a second track which allows the brake portion to slide out, the first track and the common track being joined at a junction which has an elevation difference such that the brake portion is slidable only one way from the first track to the common track, the second track and the common track being interposed by a force receiving arched surface, the brake portion slid out of the second track being pushed by the force receiving arched surface to move the blocking plate latching element to return to a closed position.

* * * * *